US010629044B2

(12) United States Patent
Pham et al.

(10) Patent No.: US 10,629,044 B2
(45) Date of Patent: Apr. 21, 2020

(54) DETECTING INCAPACITATION AND LOCATION USING NODES

(71) Applicant: Honeywell International Inc., Morris Plains, NJ (US)

(72) Inventors: Hai D. Pham, Eden Prairie, MN (US); Robert C. Becker, Golden Valley, MN (US); Adam P. Boutz, Plymouth, MN (US); Christian Larson, Golden Valley, MN (US); Conrad Ihla, Zimmerman, MN (US)

(73) Assignee: Honeywell International Inc., Morris Plains, NJ (US)

( * ) Notice: Subject to any disclaimer, the term of this patent is extended or adjusted under 35 U.S.C. 154(b) by 0 days.

(21) Appl. No.: 16/128,223

(22) Filed: Sep. 11, 2018

(65) Prior Publication Data

US 2020/0082694 A1 Mar. 12, 2020

(51) Int. Cl.
*G08B 21/02* (2006.01)

(52) U.S. Cl.
CPC ..... *G08B 21/0205* (2013.01); *G08B 21/0227* (2013.01); *G08B 21/0272* (2013.01); *G08B 21/0277* (2013.01)

(58) Field of Classification Search
CPC .... G08B 21/00; G08B 21/02; G08B 21/0205; G08B 21/04; G08B 21/0407; G08B 21/0415; G08B 21/043; G08B 21/0446; G08B 21/0461; G08B 21/0227; G08B 21/0277; G08B 21/0272
USPC ..... 340/573.1, 573.7
See application file for complete search history.

(56) References Cited

U.S. PATENT DOCUMENTS

2004/0159166 A1* 8/2004 Schiller ..... G01C 19/56 73/862.381
2010/0016745 A1* 1/2010 Crump ..... A61B 5/02055 600/519
2010/0217158 A1* 8/2010 Wolfe ..... A61B 5/113 600/595
2013/0283529 A1* 10/2013 Hayes ..... A61G 7/018 5/600
2015/0057984 A1* 2/2015 Nicoletti ..... G05B 15/02 703/2
2017/0193787 A1* 7/2017 Devdas ..... G08B 21/0261
2018/0000385 A1* 1/2018 Heaton ..... G08B 29/186
(Continued)

OTHER PUBLICATIONS

PolyPower electrostatic film measures athletic movements, harvests energy, by C.C. Weiss, Feb. 28, 2013 (Year: 2013).*
(Continued)

*Primary Examiner* — Brian Wilson
(74) *Attorney, Agent, or Firm* — Brooks, Cameron & Huebsch, PLLC

(57) ABSTRACT

Methods, devices, and systems for detecting incapacitation and location using nodes are described herein. One system for detecting incapacitation and location using nodes can include an impact sensor, and a node including a memory and a processor to execute executable instructions stored in the memory to determine an incapacitating event has occurred via the impact sensor, determine a location of the node using a plurality of nodes, where the plurality of nodes include the node, and transmit the incapacitating event and the location of the node to an external server.

16 Claims, 3 Drawing Sheets

(56) References Cited

U.S. PATENT DOCUMENTS

2018/0014150 A1* 1/2018 Elias ..... H04L 63/0861

OTHER PUBLICATIONS

"Gunshot Detection Wearable Uses Bluetooth Low Energy to Wirelessly Notify First Responders When 'Man-Down' Vest Is Pierced", Nordic Semiconductor, https://www.nordicsemi.com/News/News-releases/Product-Related-News/Gunshot-detection-wearable-uses-Bluetooth-Low-Energy-to-wirelessly-notify-first-responders-when-man-down-vest-is-pierced, Apr. 17, 2018, 1 page.

* cited by examiner

DETECTING INCAPACITATION AND LOCATION USING NODES

TECHNICAL FIELD

The present disclosure relates to methods, devices, and systems for detecting incapacitation and location using nodes.

BACKGROUND

Location tracking can be useful in many different fields. For example, individuals who may be located in high-risk areas, such as large buildings, warehouses, construction areas, industrial areas, refineries, mining areas, battlefields, where individuals may include first responders, firefighters, police, and/or military personnel, among other types of individuals in high-risk work areas, may utilize location tracking.

Location tracking of such individuals can allow for location determination in the event of an incapacitating event. For example, if an individual in a high-risk area experiences an incapacitating event, the location of the individual can be utilized by others to render assistance/aid to the incapacitated individual.

DETAILED DESCRIPTION

Figure 1:
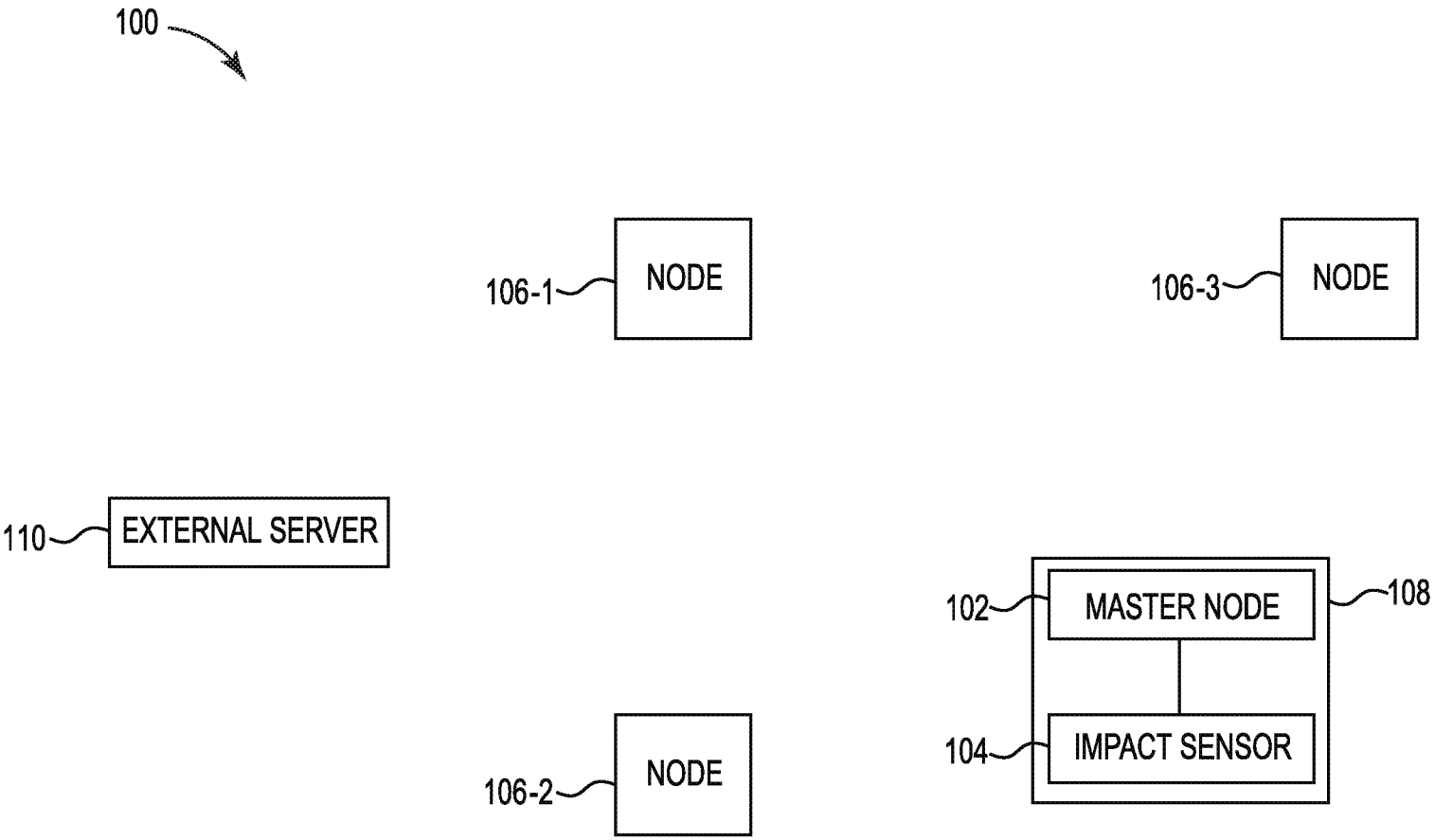
FIG. 1 illustrates an example of a system for detecting incapacitation and location using nodes, in accordance with one or more embodiments of the present disclosure.

Devices, methods, and systems for detecting incapacitation and location using nodes are described herein. For example, a system to detect incapacitation can comprise an impact sensor, and a node including a memory and a processor to execute executable instructions stored in the memory to determine an incapacitating event has occurred via the impact sensor, determine a location of the node using a plurality of nodes, wherein the plurality of nodes include the node, and transmit the incapacitating event and the location of the node to an external server.

Location determination in the event of an incapacitating event can allow for others to respond to the location of the individual who has experienced the incapacitating event. Global positioning systems (GPS) can be used in some instances to determine the location of individuals in certain environments. However, GPS can be unreliable or unavailable. For example, the individual may be located in a building where GPS is unavailable. As another example, the individual may be located in a geographical area without GPS availability. In some examples, other location determination systems not utilizing GPS may have a lengthy installation and calibration process, which can result in a delay before location determination and location tracking can begin. Delays can, in some instances, lead to severe injury or death.

Devices, methods, and systems for detecting incapacitation and location using nodes described herein can be utilized to determine when an incapacitating event has occurred and determine a location of the device to which the incapacitating event has occurred. For example, a user can wear a wearable device. The wearable device can include a node and an impact sensor. The wearable device can be, for example, a radio, mobile device, smart watch, smart goggle, smart safety vest, smart safety shoes, smart headphone, smart fall protection safety harness device, helmet, vest (e.g., tactical vest), body armor, among other types of wearable devices. The node and impact sensor can be a part of (e.g., connected to, embedded in, etc.) the wearable device. The impact sensor and node can determine whether an incapacitating event has occurred and transmit the determination such that the location of a user wearing the wearable device having the node and impact sensor can be determined.

Detecting incapacitation and location using nodes as described herein can allow for location determination of an individual who may be incapacitated. Detecting incapacitation and location using nodes can allow for the location of an incapacitated individual to be determined in an environment in which GPS, Internet, and/or mobile device (e.g., cellular telephone) service may not be available, or in an environment in which other systems not utilizing GPS may be difficult and/or lengthy to install and/or calibrate. As a result, detecting incapacitation and location using nodes can provide a quick, efficient, and inexpensive way to determine locations of incapacitated workers so that the incapacitated workers can be quickly located and medically treated, if needed.

In the following detailed description, reference is made to the accompanying drawings that form a part hereof. The drawings show, by way of illustration, how one or more embodiments of the disclosure may be practiced.

These embodiments are described in sufficient detail to enable those of ordinary skill in the art to practice one or more embodiments of this disclosure. It is to be understood that other embodiments may be utilized and that process, electrical, and/or structural changes may be made without departing from the scope of the present disclosure.

As will be appreciated, elements shown in the various embodiments herein can be added, exchanged, combined, and/or eliminated so as to provide a number of additional embodiments of the present disclosure. The proportion and the relative scale of the elements provided in the figures are intended to illustrate the embodiments of the present disclosure and should not be taken in a limiting sense.

The figures herein follow a numbering convention in which the first digit or digits correspond to the drawing figure number and the remaining digits identify an element or component in the drawing.

As used herein, "a" or "a number of" something can refer to one thing or more than one such thing. For example, "a number of process variables" can refer to one process variable or more than one process variable.

FIG. 1 illustrates an example of a system 100 for detecting incapacitation and location using nodes, in accordance with one or more embodiments of the present disclosure. As illustrated in FIG. 1, system 100 can include master node 102, impact sensor 104, nodes 106-1, 106-2, 106-3, wearable device 108, and external server 110.

As illustrated in FIG. 1, system 100 can include impact sensor 104. As used herein, the term "impact sensor" refers to a device which can determine whether a physical shock, impact, tearing of the wearable device, having impact sensor 104 being torn off wearable device, and/or piercing event has occurred. For example, impact sensor 104 can determine whether an incapacitating event has occurred, and as a result, generate a corresponding signal. In some examples, impact sensor 104 can be a thin film sensor to determine whether a physical shock, impact, tearing of the wearable device, having impact sensor 104 being torn off wearable device, and/or piercing event has occurred. In other words, an incapacitating event can be detected by impact sensor 104 if the wearable device and/or the impact sensor 104 are damaged.

In some examples, impact sensor 104 can generate a signal in response to detecting the incapacitating event having occurred. For example, in response to a physical shock, impact, tearing of the wearable device, having impact sensor 104 being torn off wearable device, and/or piercing event, impact sensor 104 can generate a signal and transmit the signal to master node 102, as is further described herein. As used herein, the term "node" refers to an electronic device capable of creating, computing, receiving, transmitting information, and/or time of flight (ToF) ranging over a communications channel.

In some examples, impact sensor 104 can transmit a periodic heartbeat signal to master node 102. For example, impact sensor 104 can periodically transmit (e.g., once every half second, one second, two seconds, etc.) a heartbeat signal to the master node 102. In response to an incapacitating event, impact sensor 104 can cease to send the heartbeat signal, as is further described herein.

Impact sensor 104 and master node 102 can be wirelessly connected. In some examples, impact sensor 104 and master node 102 can be wirelessly connected via a wireless body area network (WBAN). As used herein, the term "WBAN" refers to a wireless network of wearable computing devices. For example, master node 102 and impact sensor 104 can be part of (e.g., connected to, embedded in, etc.) a wearable device 108. The wearable device 108 can be, for example, a radio, mobile device, smart watch, smart goggle, smart safety vest, smart safety shoes, smart headphone, smart fall protection safety harness device, helmet, vest (e.g., tactical vest), body armor, among other types of wearable devices.

Although master node 102 and impact sensor 104 are described above as being wirelessly connected via a WBAN, embodiments of the present disclosure are not so limited. For example, master node 102 and impact sensor 104 can be connected via Bluetooth, Bluetooth mesh, Low Power Bluetooth, Wi-Fi, and/or other wireless communication techniques.

Master node 102 can determine an incapacitating event has occurred via impact sensor 104. In some examples, the incapacitating event can be an impact. However, embodiments of the present disclosure are not so limited. For example, the incapacitating event can be a physical shock and/or piercing event. The physical shock, impact, and/or piercing event (e.g., piercing of the wearable device 108 having the master node102/impact sensor 104) can be an event caused by a physical impact such as by a bullet, knife, shrapnel, debris, a fall (e.g., the individual falls over and impacts the ground or other surface and/or the ground/surface presses against the impact sensor 104), among other causes. For instance, a user may be wearing wearable device 108 and be hit by debris. The debris can impact wearable device 108 and cause master node 102 to determine an incapacitating event has occurred, as is further described herein.

As described above, in some examples, impact sensor 104 can generate a signal in response to detecting the incapacitating event having occurred. For example, impact sensor 104 can generate a signal in response to a physical shock, impact, and/or piercing event occurring to the wearable device 108. Impact sensor 104 can transmit the generated signal to master node 102. Impact sensor 104 can transmit the generated signal to master node 102 wirelessly (e.g., via a WBAN). Master node 102 can determine the incapacitating event has occurred in response to the generated signal being received by master node 102 from impact sensor 104.

In some examples, master node 102 can be in a low-power state. As used herein, the term "low-power state" refers to a state in which master node 102 is able to switch to a high-power state in the event of a hardware/network event but consumes less power than the high-power state. As used herein, the term "high-power state" refers to a state in which hardware components of master node 102 are fully usable.

Master node 102 can transition from the low-power state to a high-power state. For example, master node 102 can transition from the low-power state to the high-power state in response to receiving the generated signal from the impact sensor 104 in response to the impact sensor 104 detecting an incapacitating event having occurred.

As described above, in some examples, impact sensor 104 can transmit a periodic heartbeat signal to master node 102. As used herein, the term "heartbeat signal" refers to a periodic signal generated and transmitted by impact sensor 104 to master node 102 at regular intervals (e.g., every three seconds). Impact sensor 104 can transmit the heartbeat signal to master node 102 wirelessly (e.g., via a WBAN).

In response to an incapacitating event having occurred to the wearable device 108, impact sensor 104 can cease sending the heartbeat signal to master node 102. For example, in response to a physical shock, impact, and/or piercing event, impact sensor 104 can cease sending the heartbeat signal to master node 102. Master node 102 can determine the incapacitating event has occurred in response to the periodic heartbeat signal not being received.

In some examples, in response to master node 102 not receiving the heartbeat signal after a threshold period of time, master node 102 can determine an incapacitating event has occurred. For instance, master node 102 can determine an incapacitating event has occurred in response to the master node 102 not receiving the heartbeat signal after five seconds, although embodiments of the present disclosure are not limited to a threshold period of time of five seconds (e.g., the threshold time can be more than five seconds or less than five seconds, and/or can be configurable).

In some examples, in response to master node 102 not receiving the heartbeat signal after a threshold number of heartbeat signal checks, master node 102 can determine an incapacitating event has occurred. For instance, master node 102 can determine an incapacitating event has occurred in response to the master node 102 not receiving the heartbeat signal after three heartbeat signal checks (e.g., check whether the heartbeat signal has been received three times, once every three seconds), although embodiments of the present disclosure are not limited to a threshold number of heartbeat signal checks (e.g., the threshold number of heartbeat signal checks can be more than three or less than three, and/or can be configurable).

As illustrated in FIG. 1, system 100 can include nodes 106-1, 106-2, 106-3, as well as master node 102. Nodes 106-1, 106-2, 106-3 can include transceivers for bi-directional communication, mobility, and localization functions.

Master node 102 can wirelessly transmit location determination signals to nodes 106-1, 106-2, and/or 106-3. The location determination signals can be received by nodes 106-1, 106-2, and/or 106-3 and sent back to master node 102.

Location determination signals can be sent by master node 102 to nodes 106-1, 106-2, and/or 106-3 via Long Range (LoRa) wireless communication and can include time of flight (ToF) information. For example, master node 102 can utilize LoRa to transmit location determination signals to nodes 106-1, 106-2, and/or 106-3. Master node 102 can determine ToF information from the location determination signals to nodes 106-1, 106-2, and/or 106-3 (e.g., from the respective corresponding location determination signals from master node 102 to nodes 106-1, 106-2, and/or 106-3). For instance, master node 102 can determine ToF information from a location determination signal sent from master node 102 to node 106-1, determine ToF information from a location determination signal sent from master node 102 to node 106-2, and/or determine ToF information from a location determination signal sent from master node 102 to node 106-3.

As illustrated in FIG. 1, nodes 106-1, 106-2, and 106-3 can be static. For example, nodes 106-1, 106-2, and/or 106-3 can be deployed for location determination in an area to determine locations of dynamic objects in the area. For instance, wearable device 108 having master node 102 and impact sensor 104 can move around an area, where nodes 106-1, 106-2, and/or 106-3 do not move. That is, master node 102 and impact sensor 104 can move relative to nodes 106-1, 106-2, and/or 106-3.

Master node 102 can poll nodes 106-1, 106-2, and 106-3. For example, master node 102 can transmit location determination signals to nodes 106-1, 106-2, and 106-3. The location determination signals can be ToF ranging signals.

Master node 102 can utilize ToF information of the transmit location determination signals (e.g., ToF ranging signals) to determine a location of master node 102 via trilateration. Master node 102 can determine the location of master node 102 via a trilateration algorithm. As used herein, the term "trilateration" refers to determining absolute or relative locations of points by measurement of distances. For example, utilizing the ToF information of the transmit location determination signals, master node 102 can determine distances from each respective node 106-1, 106-2, 106-3 and using trilateration determine its location relative to nodes 106-1, 106-2, and 106-3.

Although system 100 is illustrated in FIG. 1 as including three nodes 106-1, 106-2, 106-3, embodiments of the present disclosure are not so limited. For example, system 100 can include more than three nodes.

Master node 102 can transmit the incapacitating event and the location of master node 102 to an external server 110. In some examples, master node 102 can transmit the incapacitating event and the location of master node 102 to external server 110 wirelessly. For example, master node 102 can utilize LoRa wireless communication to transmit the incapacitating event and the location of master node 102 to an external server 110. However, embodiments of the present disclosure are not so limited. For example, master node 102 can utilize Wi-Fi, cellular, and/or any other wireless communication technique to transmit the incapacitating event and the location of master node 102 to an external server 110.

In some examples, master node 102 can transmit the incapacitating event and the location of master node 102 to a mobile device connected to external server 110. For example, the external server 110 may be a remote command center and search and rescue personnel may utilize the mobile device. The mobile device may be utilized by the search and rescue personnel to locate a user who may be incapacitated by receiving the incapacitating event and the location of master node 102 from master node 102.

Detecting incapacitation and location using nodes as described herein can allow for fast and efficient location determination. For example, determining a location of a user having a wearable device with the master node and impact sensor can allow for the determination of the location of the user in a scenario in which an incapacitating event occurs to the user. In such an event, the user can be quickly located such that aid and/or other attention may be given to the user. Further, detecting incapacitation and location using nodes according to the disclosure can allow for an inexpensive system for and quick deployment of location tracking.

Figure 2:
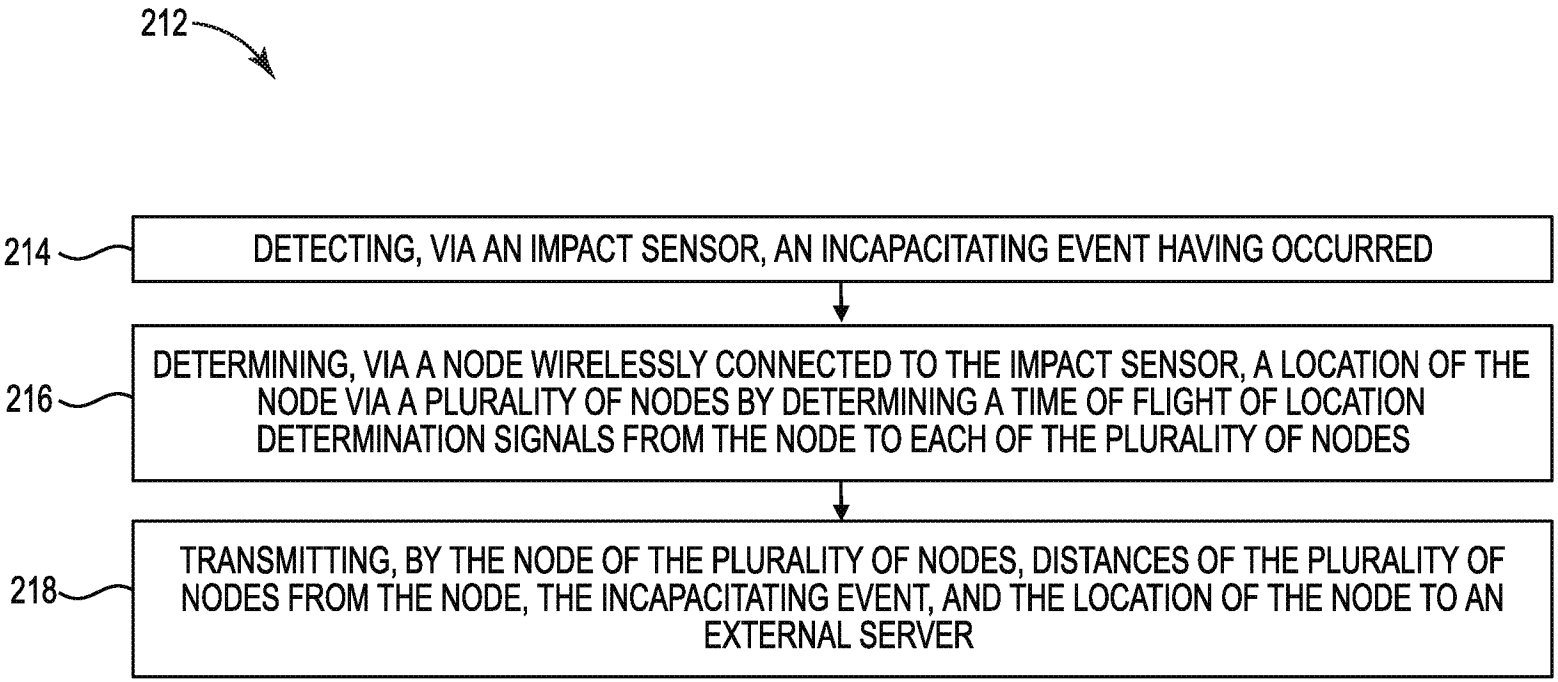
FIG. 2 illustrates an example of a method for detecting incapacitation and location using nodes, in accordance with one or more embodiments of the present disclosure.

FIG. 2 illustrates an example of a method 212 for detecting incapacitation and location using nodes, in accordance with one or more embodiments of the present disclosure. Method 212 can be performed in part by, for example, a master node (e.g., master node 102, 302, described in connection with FIGS. 1 and 3, respectively).

At 214, the method 212 can include detecting, via an impact sensor, an incapacitating event having occurred. An incapacitating event can include a physical shock, impact, and/or piercing event to a wearable device including the impact sensor. That is, the impact sensor can detect whether a physical shock, impact, and/or piercing event has occurred to the wearable device having the impact sensor.

In some examples, the impact sensor can generate a signal in response to detecting the incapacitating event having occurred. The impact sensor can send the generated signal to a node (e.g., master node 102, 302, described in connection with FIGS. 1 and 3, respectively), where the node can determine an incapacitating event has occurred.

In some examples, the impact sensor can transmit a periodic heartbeat signal to the node. In response to an incapacitating event, the impact sensor can cease transmission of the periodic heartbeat signal to the node. In response, the node can determine an incapacitating event has occurred.

At 216, the method 212 can include determining, via a node wirelessly connected to the impact sensor, a location of the node via a plurality of nodes (e.g., at least three nodes). For example, the node can be located within an area having at least three static nodes having predetermined locations. The node can determine a distance of the node from each of the at least three static nodes by determining ToF information from location determination signals sent by the node to each of the at least three static nodes. The node can utilize the ToF information from the location determination signals to determine its location utilizing trilateration. The determined location of the node can be a location relative to the locations of the at least three nodes. In some examples, the node can be a master node, and at least one node of the at least three nodes can be a slave node.

At 218, the method 212 can include transmitting, by the node of the plurality of nodes, distances of the plurality of nodes from the node, the incapacitating event, and the location of the node to an external server. For example, the node can wirelessly transmit, via LoRa wireless communication, distances of the plurality of nodes from the node, the incapacitating event, and the location of the node to the external server.

Wirelessly transmitting the incapacitating event can include wirelessly transmitting a severity of the incapacitating event. A severity of the incapacitating event can be determined by an amount of incapacitating events determined (e.g., an amount of physical shocks, impacts, and/or piercing events detected), a rate at which the periodic heartbeat signal of impact sensor 104 is transmitted, whether the wearable device including the impact sensor is moving (e.g., whether a user wearing the wearable device having the impact sensor is moving), where movement may be determined by the WBAN and/or an accelerometer included in the wearable device/impact sensor, and/or combinations thereof. In some examples, a higher number of incapacitating events detected can indicate a higher severity (e.g., exceeding a threshold number of incapacitating events indicates the higher severity), whereas a lower number of incapacitating events can indicate a lower severity (e.g., not exceeding the threshold number of incapacitating events). In some examples, the periodic transmission rate of the heartbeat signal can indicate a higher severity (e.g., transmission rate is below a threshold rate or stops completely), whereas a lower number of incapacitating events can indicate a lower severity (e.g., transmission rate slows but not below the threshold rate). In some examples, little or no movement detected by the accelerometer can indicate a higher severity (e.g., movement is below a threshold acceleration amount or no movement/acceleration at all), whereas more movement can indicate a lower severity (e.g., movement is not below the threshold acceleration amount).

Utilizing the external server, other personnel can track the location of a user wearing a wearable device having the node and the impact sensor. In such an example, when an incapacitating event occurs, the other personnel can determine the location of the user and respond to the incapacitating event to render aid and/or other assistance to the user having experienced the incapacitating event.

Figure 3:
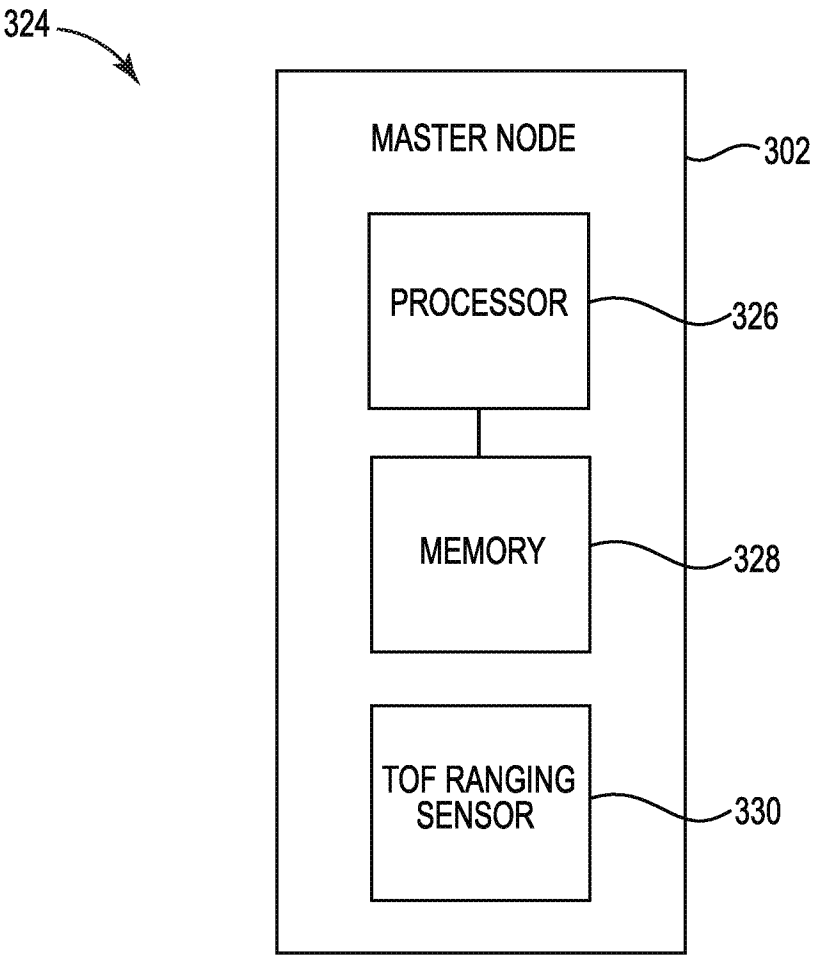
FIG. 3 illustrates an example master node for detecting incapacitation and location using nodes, in accordance with one or more embodiments of the present disclosure.

FIG. 3 illustrates an example master node 302 for detecting incapacitation and location using nodes, in accordance with one or more embodiments of the present disclosure. Master node 302 can be, for example, connected to an impact sensor (e.g., impact sensor 104, previously described in connection with FIG. 1).

As shown in FIG. 3, master node 302 includes a memory 328, a processing resource 326 (e.g., processor) coupled to memory 328, and a ToF Ranging sensor 330. Memory 328 can be any type of storage medium that can be accessed by processor 326 to perform various examples of the present disclosure. For example, memory 328 can be a non-transitory computer readable medium having computer readable instructions (e.g., computer program instructions) stored thereon that are executable by processor 326 to location determination using nodes in accordance with one or more embodiments of the present disclosure.

Memory 328 can be volatile or nonvolatile memory. Memory 328 can also be removable (e.g., portable) memory, or non-removable (e.g., internal) memory. For example, memory 328 can be random access memory (RAM) (e.g., dynamic random access memory (DRAM) and/or phase change random access memory (PCRAM)), read-only memory (ROM) (e.g., electrically erasable programmable read-only memory (EEPROM) and/or compact-disc read-only memory (CD-ROM)), flash memory, a laser disc, a digital versatile disc (DVD) or other optical disk storage, and/or a magnetic medium such as magnetic cassettes, tapes, or disks, among other types of memory.

Further, although memory 328 is illustrated as being located in master node 302, embodiments of the present disclosure are not so limited. For example, memory 328 can also be located internal to another computing resource (e.g., enabling computer readable instructions to be downloaded over the Internet or another wired or wireless connection).

Master node 302 can include ToF ranging sensor 330. ToF ranging sensor 330 can be utilized to transmit location determination signals (e.g., ToF ranging signals) to nodes. For example, ToF ranging sensor 330 can transmit a ToF ranging signal and master node 302 can start an internal timer. When ToF ranging sensor 330 receives a response signal, master node 302/ToF ranging sensor 330 can determine a time of flight of the location determination signal from the master node 302/ToF ranging sensor 330, to the node, and back to the master node 302/ToF ranging sensor 330 (e.g., the time taken for the electromagnetic wave of a transmit location determination signal to propagate from ToF ranging sensor 330, to the node, and back again).

Although specific embodiments have been illustrated and described herein, those of ordinary skill in the art will appreciate that any arrangement calculated to achieve the same techniques can be substituted for the specific embodiments shown. This disclosure is intended to cover any and all adaptations or variations of various embodiments of the disclosure.

It is to be understood that the above description has been made in an illustrative fashion, and not a restrictive one. Combination of the above embodiments, and other embodiments not specifically described herein will be apparent to those of skill in the art upon reviewing the above description.

The scope of the various embodiments of the disclosure includes any other applications in which the above structures and methods are used. Therefore, the scope of various embodiments of the disclosure should be determined with reference to the appended claims, along with the full range of equivalents to which such claims are entitled.

In the foregoing Detailed Description, various features are grouped together in example embodiments illustrated in the figures for the purpose of streamlining the disclosure. This method of disclosure is not to be interpreted as reflecting an intention that the embodiments of the disclosure require more features than are expressly recited in each claim.

Rather, as the following claims reflect, inventive subject matter lies in less than all features of a single disclosed embodiment. Thus, the following claims are hereby incorporated into the Detailed Description, with each claim standing on its own as a separate embodiment.

What is claimed:

1. A system to detect incapacitation, comprising:

a wearable device, comprising:

a thin-film impact sensor; and a master node wirelessly connected to the thin-film impact sensor and including a memory and a processor configured to execute executable instructions stored in the memory to:

determine an incapacitating event has occurred via the thin-film impact sensor;

transmit location determination signals to a plurality of nodes via Long Range (LoRa) wireless communication, wherein the plurality of nodes include at least three other nodes and wherein the location determination signals include time of flight (ToF) information;

determine a location of the master node using the ToF information from the location determination signals sent to the plurality of nodes; and transmit the incapacitating event and the location of the master node to an external server.

2. The system of claim 1, wherein the thin-film impact sensor:

generates a signal in response to the thin-film impact sensor detecting the incapacitating event having occurred; and wirelessly transmits the generated signal to the master node.

3. The system of claim 2, wherein the master node determines the incapacitating event has occurred in response to the generated signal being received by the master node from the thin-film impact sensor.

4. The system of claim 1, wherein the thin-film impact sensor transmits a periodic heartbeat signal to the master node.

5. The system of claim 4, wherein the master node determines the incapacitating event has occurred in response to the periodic heartbeat signal not being received.

6. The system of claim 1, wherein the system further includes the plurality of nodes.

7. The system of claim 6, wherein the master node of the plurality of nodes wirelessly transmits the incapacitating event and the location of the master node to the external server.

8. The system of claim 1, wherein the incapacitating event is an impact.

9. The system of claim 1, wherein:

the master node is in a low-power state; and the master node transitions from the low-power state to a high-power state in response to receiving a signal generated by the thin-film impact sensor in response to the thin-film impact sensor detecting the incapacitating event having occurred.

10. A master node, comprising:

a memory; and a processor configured to execute executable instructions stored in the memory to:

determine an incapacitating event has occurred via a thin-film impact sensor wirelessly connected to the master node, wherein the master node and the thin-film impact sensor are included in a wearable device;

wirelessly transmit location determination signals to each of a plurality of nodes via Long Range (LoRa) wireless communication in response to the incapacitating event occurring, wherein the plurality of nodes include at least three other nodes and wherein the location determination signals include time of flight (ToF) information;

determine a location of the master node via the plurality of nodes utilizing the ToF information from the respective corresponding location determination signals; and wirelessly transmit the incapacitating event and the location of the master node to an external server.

11. The node of claim 10, wherein the processor is configured to execute the instructions to wirelessly transmit the incapacitating event and the location of the master node via LoRa wireless communication.

12. The node of claim 10, wherein the master node is wirelessly connected to the thin-film impact sensor via a wireless body area network (WBAN).

13. A method for detecting incapacitation, comprising:

detecting, via a thin-film impact sensor of a wearable device, an incapacitating event having occurred;

transmitting, by a master node of the wearable device and wirelessly connected to the thin-film impact sensor, location determination signals to a plurality of nodes via Long Range (LoRa) wireless communication, wherein the plurality of nodes include at least three other nodes and wherein the location determination signals include time of flight (ToF) information;

determining, by the master node, a location of the master node the plurality of nodes utilizing the ToF information from the respective corresponding location determination signals; and wirelessly transmitting, by the master node of the plurality of nodes, distances of the plurality of nodes from the master node, the incapacitating event, and the location of the master node to an external server.

14. The method of claim 13, wherein the method includes determining the location of the master node relative to the plurality of nodes utilizing trilateration.

15. The method of claim 13, wherein wirelessly transmitting the incapacitating event includes wirelessly transmitting a severity of the incapacitating event.

16. The method of claim 13, wherein the method includes determining the location of the master node via the at least three nodes utilizing the time of flight of the location determination signals and trilateration.

* * * * *